US005544391A

United States Patent [19]

Hoffman

[11] Patent Number: 5,544,391

[45] Date of Patent: Aug. 13, 1996

[54] TIE HEAD AND FASTENING SYSTEM

[75] Inventor: Richard A. Hoffman, Landenberg, Pa.

[73] Assignee: Dymetrol Company, Inc., Hockessin, Del.

[21] Appl. No.: 418,701

[22] Filed: Apr. 7, 1995

[51] Int. Cl.[6] ..... B65D 63/00

[52] U.S. Cl. ..... 24/16 PB; 24/30.5 P

[58] Field of Search ..... 24/16 R, 16 PB, 24/30.5 R, 17 AP, 30.5 P

[56] References Cited

U.S. PATENT DOCUMENTS 3,588,961 6/1971 Farago ..... 24/16 PB
4,422,217 12/1983 Barrette .
4,498,507 2/1985 Thompson .
4,993,669 2/1991 Dyer .
5,102,075 4/1992 Dyer .
5,193,251 3/1993 Fortsch .

*Primary Examiner*—James R. Brittain
*Attorney, Agent, or Firm*—Donald W. Huntley

[57] ABSTRACT

A tie head for use with elongate plastic strap comprising a housing and a substantially V-shaped spring pawl pivotally mounted within the housing for engagement of strap inserted into the housing.

16 Claims, 1 Drawing Sheet

TIE HEAD AND FASTENING SYSTEM

BACKGROUND OF THE INVENTION

Polymeric strapping is extensively used in conjunction with tie heads to anchor bundles of objects, such as utility wires and lengths of rod or pipe. Fastening systems previously developed for such applications typically included a tie head through which a strapping material was inserted, the head including barbs or clipping means for retaining the strap in the tie head. Continuing effort has been directed toward the improvement of such systems, and particularly the efficiency and reliability of such tie heads and their combination with specific strapping materials.

SUMMARY OF THE INVENTION

The instant invention provides an improved tie head for use with elongate plastic tie strap having outstanding performance characteristics and a minimum of components, and a combination of this tie head with tie strap to provide a bundling system.

Specifically, the present invention provides a tie head for use with an elongate plastic tie strap to form a bundle tie, the tie head comprising:

(a) a housing including a pair of spaced-apart slots extending therein forming a pair of strap-receiving passageways, each passageway having an entrance opening and at least one of the passageways having an exit opening, the housing further including a pawl-receiving channel extending intermediate the passageways, the channel having a portion intersecting each said passageway; and (b) a spring pawl having a substantially V-shaped configuration pivotally mounted at its vertex in the channel, and including two arm portions extending outwardly from the vertex of the V, each arm having a free end with a toothed edge, each toothed edge positioned to extend into one of the strap-receiving passageways to provide an engagement of the toothed edge with an inserted tie strap; whereby a tie strap inserted through the entrance openings into each passageway is retained by the tie head against withdrawal by gripping engagement of the strap between the toothed edges of the pawl and the surfaces of the passageways.

The present invention further comprises a bundling system including the tie head in combination with an elongate plastic tie strap, and particularly those straps which are oriented in at least the machine direction.

DETAILED DESCRIPTION OF THE INVENTION

Figure 3:
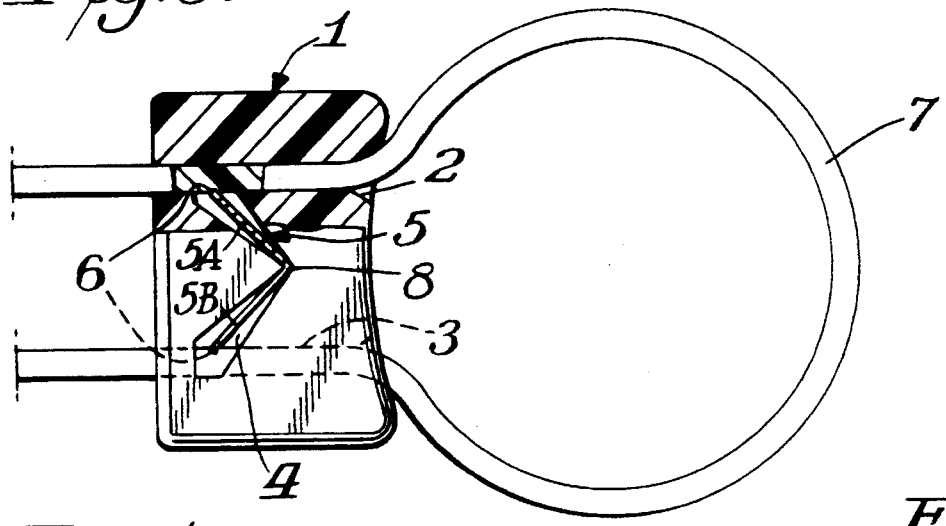
FIG. 3 is a right end elevational view of a tie head of the invention, partially broken away to show the engagement of the teeth of the spring pawl with the strap in place.

The tie head of the present invention comprises a housing and a spring pawl pivotally mounted within the housing to receive an elongate plastic tie strap which is anchored by the tie head. The housing can be prepared from a wide variety of materials, including thermoplastic and thermoset resins. Polyamides and polyacetels have been found to be particularly satisfactory. Polyamides which can be used include nylon 6, nylon 66, nylon 610 and nylon 612 molding resins. Polyacetels have been found to be particularly satisfactory for the construction of the housing in the present tie heads.

A second component of the present tie heads is a spring pawl having a substantially V-shape configuration. The spring pawl can be made of any suitable spring material, such as stainless steel. This material should be selected so that the pawl, in flexing during use of the tie head, will not exceed its elastic limit. The size and thickness of the spring pawl will necessarily be adjusted to the size of the head as well as the size of plastic tie wrap to be anchored. For many applications, a spring steel having a thickness of about from 0.005 to 0.020 inch can be used effectively.

Figure 1:
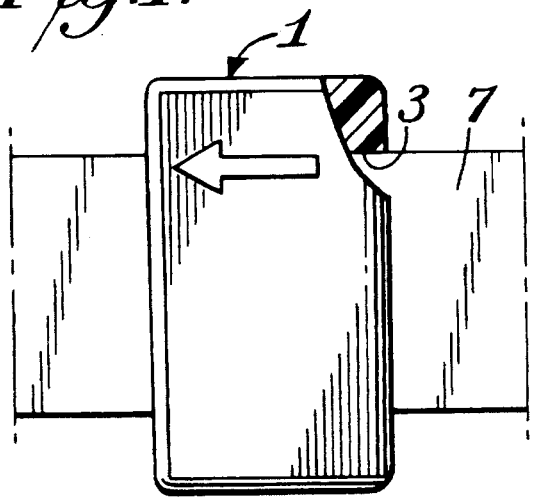
FIG. 1 is a side elevational view of a tie head of the invention, partly broken away to show insertion of a strap.
Figure 2:
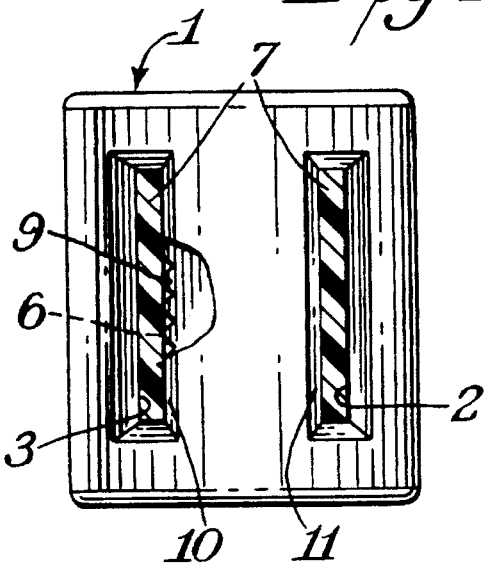
FIG. 2 is a top plan view of FIG. 1, partially broken away.
Figure 5:
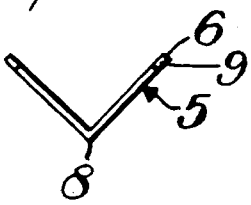
FIG. 5 is an end view of the spring pawl.

The present invention can be more fully understood by reference to the drawings, in which FIG. 1 is a side view of a tie head of the present invention; FIG. 2 is top plan view of FIG. 1, partly broken away; and FIG. 3 is a right end elevational view, partly broken away to show the engagement of the teeth of the spring pawl with the strap. Like numbers are used for like elements in the Figures. With reference to FIG. 1, housing 1 includes a pair of spaced apart slots 2 and 3 extending inwardly to form a pair of strap-receiving passageways. Each of the passageways has an entrance opening and at least one of the passageways has an exit opening. The housing further includes a pawl-receiving channel 4, as shown in FIG. 3, extending intermediate the passageways, the channel having a portion intersecting each of the passageways.

Figure 4:
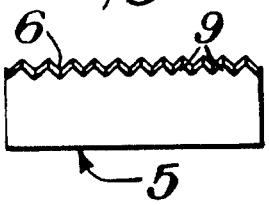
FIG. 4 is a side view of the spring pawl.
Figure 6:
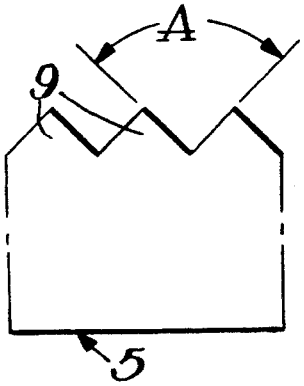
FIG. 6 is a tooth detail layout of the spring pawl.

A spring pawl 5, having a substantially V-shaped configuration, is pivotally mounted in the channel and has two arm portions 5A and 5B extending outwardly from opposed sides of the base of the V. The arms each have a toothed edge 6, shown in greater detail in FIGS. 4 and 6. In general, the angle of the teeth on this edge, illustrated as A in FIG. 6, can vary, depending on the degree of gripping desired. However, in general, angle A can be about from 60 to 120 degrees, and preferably a substantially right or 90° angle. In the use of a tie head of the present invention, an elongate plastic tie strap, shown as element 7 in FIG. 3, is inserted into one of the strap-receiving passageways 2 and 3, with the other end inserted into the second strap-receiving passageway. The spring pawl, pivotally mounted at its base 8 in the pawl-receiving channel, extends into the strap-receiving passageways to provide an engagement of the toothed edge of the pawl with the inserted tie strap.

The teeth 9 of the spring pawl preferably have a depth of less than about one half the width of the strap-receiving passageway. In general, each arm of the pawl extends into its corresponding strap-receiving passageway by at least about 25% of the width of the passageway. The specific design of the teeth can vary somewhat with the materials used, the depth to which the teeth embed in the strap, and the angle of embedding. However, the general configuration of the teeth is pointed, that is, the tip has an angle of less than about 120°, and preferably less than about 100°. The teeth generally come to a point, with a tip of less than about 0.010 inch, and preferably less than about 0.005 inch. The teeth preferably extend across substantially the full width of the engaged strap.

As can be seen more clearly in FIG. 3, the arms of the pawl-receiving channels are wider than the channel at its base, permitting the arms of the pawl to flex within the channel. Preferably, the channel has a substantially tear drop configuration to facilitate flexing of the pawl within the channel.

The angle of the spring pawl with regard to the inserted strap is less than 90°, and generally about from 30° to 70°, with respect to the strap-receiving passageways, for satisfactory engagement of the pawl and the inserted strap.

The elongate plastic tie strap can be prepared from a wide variety of thermoplastic materials, including polyamides, polyesters, polyacetals and copolyetheresters. Tie strap prepared from polyacetals has been found to be particularly satisfactory, since this material is highly stable under long term weathering conditions. Typically, such materials are produced in sheet form, oriented, and then slit to the precise size and shape required. Moreover, this material, when molecularly oriented by rolling or drawing, permits more precise dimensional control of the tie strap, and results in greater strength of the strap. Thus, a smaller size can be used, with lower weight, and equal or even greater break strength. This is particularly beneficial, for example, in the telecommunications industry, in which the weight carried by a line repairman is important. The thinner strap, in turn, provides greater flexibility.

In the operation of the tie head, on insertion of the plastic tie strap into one of the strap-receiving passageways, the spring pawl is deflected within the pawl-receiving channel in the direction of the movement of the strap being inserted. However, on attempted withdrawal of the strap, the toothed edge of the pawl engages the strap, preventing further reverse motion.

The openings of the strap-receiving passageways 2 and 3 preferably include chamfered sections 9 and 10 to facilitate insertion of the strap into the passageway. An angle of about 30° has been found to be satisfactory for such chamfering.

I claim:

1. A tie head for use with an elongate plastic tie strap to form a bundle tie, the tie head comprising:

(a) a housing including a pair of spaced-apart slots extending therein forming a pair of strap-receiving passageways, each passageway having an entrance opening and at least one of the passageways having an exit opening, the housing further including a pawl-receiving channel extending intermediate the passageways, the channel having a portion intersecting each said passageway; and (b) a spring pawl having a substantially V-shaped configuration pivotally mounted at its vertex in the channel, and including two arm extending outwardly from the vertex of the V, each arm having a free end with a toothed edge, each toothed edge positioned to extend into one of the strap-receiving passageways to provide an engagement of the toothed edge with an inserted tie strap;

whereby a tie strap inserted through the entrance openings into each passageway is retained by the tie head against withdrawal by gripping engagement of the strap between the toothed edges of the pawl and the surfaces of the passageways.

2. A tie head of claim 1 wherein each arm of the pawl extends into a strap-receiving passageway by at least about 25% of the width of the passageway.

3. A tie head of claim 1 wherein the pawl is metal.

4. A tie head of claim 3 wherein the pawl is stainless steel.

5. A tie head of claim 4 wherein the metal is a non-corroding stainless steel.

6. A tie head of claim 1 wherein the teeth on the pawl have a depth of less than about one half the width of the strap-receiving passageway.

7. A tie head of claim 1 further comprising an elongate plastic tie strap inserted into at least one passageway.

8. A tie head of claim 7 wherein the teeth on the pawl have a depth of less than about one half the thickness of the tie strap.

9. A tie head of claim 7 wherein the plastic material, of the strap consists essentially of polyacetal.

10. A tie head of claim 9 wherein the plastic tie strap is molecularly oriented.

11. A tie head of claim 7 wherein the plastic tie strap is molecularly oriented.

12. A tie head of claim 7 wherein the toothed edge of the pawl extends across substantially the full width of the inserted tie strap.

13. A tie head of claim 1 wherein the teeth on the pawl are pointed.

14. A tie head of claim 13 wherein the points of the teeth form an angle of less than about 120°.

15. A tie head of claim 1 wherein the pawl-receiving channel has a substantially V-shaped configuration in which the arms of the V are of sufficient width to permit the pawl to pivot and flex.

16. A tie head of claim 15 wherein upper arms of the channel have a substantially tear-drop configuration.

* * * * *